US011309108B2

(12) United States Patent
Kudo

(10) Patent No.: US 11,309,108 B2
(45) Date of Patent: Apr. 19, 2022

(54) R-T-B BASED PERMANENT MAGNET

(71) Applicant: TDK Corporation, Tokyo (JP)

(72) Inventor: Hikaru Kudo, Tokyo (JP)

(73) Assignee: TDK Corporation, Tokyo (JP)

( * ) Notice: Subject to any disclaimer, the term of this patent is extended or adjusted under 35 U.S.C. 154(b) by 89 days.

(21) Appl. No.: 16/818,308

(22) Filed: Mar. 13, 2020

(65) Prior Publication Data

US 2020/0303101 A1 Sep. 24, 2020

(30) Foreign Application Priority Data

Mar. 18, 2019 (JP) ..... JP2019-050064

(51) Int. Cl.

| | |
|---|---|
| ***H01F 1/057*** | (2006.01) |
| ***H01F 41/02*** | (2006.01) |
| ***H01F 7/02*** | (2006.01) |
| ***C22C 38/16*** | (2006.01) |
| ***C22C 38/00*** | (2006.01) |
| ***C22C 38/10*** | (2006.01) |

(52) U.S. Cl.

CPC ..... *H01F 1/0577* (2013.01); *C22C 38/005* (2013.01); *C22C 38/10* (2013.01); *C22C 38/16* (2013.01); *H01F 7/02* (2013.01); *H01F 41/0293* (2013.01)

(58) Field of Classification Search

None

See application file for complete search history.

(56) References Cited

U.S. PATENT DOCUMENTS

2011/0279205 A1* 11/2011 Fukui ..... C22C 38/005 335/302
2018/0040399 A1* 2/2018 Miyazaki ..... H01F 1/0577

FOREIGN PATENT DOCUMENTS

JP 2014-132628 A 7/2014

* cited by examiner

*Primary Examiner* — Xiaowei Su

(74) *Attorney, Agent, or Firm* — Faegre Drinker Biddle & Reath LLP

(57) ABSTRACT

A permanent magnet includes Nd, Fe, B, and Ga and contains a first T rich phase 1, a second T rich phase 3, and a T poor phase 5 as grain boundary phases, the first T rich phase 1 satisfies 1.7≤[T]/[R]≤3.0, the second T rich phase 3 satisfies 0.8≤[T]/[R]≤1.5, the T poor phase 5 satisfies 0.0≤[T]/[R]≤0.6, and the following Formulas 4 and 5 are satisfied. [T] represents the concentration (atom %) of Fe and Co, [R] represents the concentration (atom %) of Nd, Pr, Tb, and Dy, S1 represents the area of the first T rich phase 1 exposed at a cross-section of the permanent magnet, S2 represents the area of the second T rich phase 3 exposed at the cross-section, and S3 represents the area of the T poor phase 5 exposed at the cross-section.

$$0.30 \leq (S1+S2)/(S1+S2+S3) \leq 0.80 \quad (4)$$

$$0.20 \leq S2/(S1+S2) \leq 0.80 \quad (5)$$

5 Claims, 5 Drawing Sheets

R-T-B BASED PERMANENT MAGNET

TECHNICAL FIELD

The present invention relates to an R-T-B based permanent magnet containing at least a rare earth element R, a transition metal element T, and boron B.

BACKGROUND

R-T-B based permanent magnets have excellent magnetic characteristics, and therefore, those permanent magnets are used for the motors, actuators, or the like that are mounted in hybrid cars, electric cars, electronic equipment, electric appliances, or the like. The R-T-B based permanent magnets that are used in motors and the like are required to have high coercivity even in a high-temperature environment.

As a technique for enhancing the coercivity (HcJ) at high temperature of an R-T-B based permanent magnet, it is known that a portion of the light rare earth element (Nd or Pr) that constitutes the $R_2T_{14}B$ phase is substituted with a heavy rare earth element such as Dy or Tb, and thereby the magnetic anisotropy of $R_2T_{14}B$ phase is enhanced. In recent years, the demand for a high coercivity type R-T-B based permanent magnet that requires a large amount of a heavy rare earth element is rapidly increasing.

However, heavy rare earth elements are localized in certain countries as resources, and the production amounts thereof are limited. Therefore, heavy rare earth elements are highly expensive compared to light rare earth elements, and the supply amounts thereof are not stabilized. Therefore, there is a demand for an R-T-B based permanent magnet having high coercivity at high temperature even in a case in which the content of a heavy rare earth element is small.

For example, in Japanese Unexamined Patent Publication No. 2014-132628, an example of a permanent magnet having high coercivity without using a heavy rare earth element is disclosed. The permanent magnet described in Japanese Unexamined Patent Publication No. 2014-132628 comprises a main phase and a grain boundary phase, and the grain boundary phase contains an R rich phase in which the total atomic concentration of rare earth elements is 70 atom % or more; and a ferromagnetic transition metal rich phase in which the total atomic concentration of rare earth elements is 25 atom % to 35 atom %. The area ratio of the transition metal rich phase in this grain boundary phase is 40% or more.

SUMMARY

However, in a case in which the content of a heavy rare earth element in an R-T-B based permanent magnet is small, it has been difficult to achieve sufficiently high coercivity in a high-temperature environment to which a driving motor for a vehicle and the like are exposed.

An object of the present invention is to provide an R-T-B based permanent magnet having high coercivity at high temperature even in a case in which the content of a heavy rare earth element in the R-T-B based permanent magnet is small.

An R-T-B based permanent magnet according to an aspect of the present invention is an R-T-B based permanent magnet including a rare earth element R, a transition metal element T, B, and Ga. The R-T-B based permanent magnet includes at least Nd as R, the R-T-B based permanent magnet includes at least Fe as T, the R-T-B based permanent magnet comprises a plurality of main phase grains containing Nd, T, and B; and grain boundaries surrounded by a plurality of the main phase grains, at least a portion of the grain boundaries contains a first T rich phase, at least a portion of the grain boundaries contains a second T rich phase, at least a portion of the grain boundaries contains a T poor phase, the first T rich phase is a phase containing Nd, Ga, and at least one of Fe and Co and satisfying the following Formula 1, the second T rich phase is a phase containing Nd, Ga, and at least one of Fe and Co and satisfying the following Formula 2, the T poor phase is a phase containing Nd and satisfying the following Formula 3, the first T rich phase, the second T rich phase, and the T poor phase satisfy the following Formula 4, and the first T rich phase and the second T rich phase satisfy the following Formula 5.

$$1.7 \leq [T]/[R] \leq 3.0 \quad (1)$$

$$0.8 \leq [T]/[R] \leq 1.5 \quad (2)$$

$$0.0 \leq [T]/[R] \leq 0.6 \quad (3)$$

wherein [T] in Formula 1 represents the sum of the concentrations of Fe and Co in the first T rich phase; [R] in Formula 1 represents the sum of the concentrations of Nd, Pr, Tb, and Dy in the first T rich phase; [T] in Formula 2 represents the sum of the concentrations of Fe and Co in the second T rich phase; [R] in Formula 2 represents the sum of the concentrations of Nd, Pr, Tb, and Dy in the second T rich phase; [T] in Formula 3 represents the sum of the concentrations of Fe and Co in the T poor phase; [R] in Formula 3 represents the sum of the concentrations of Nd, Pr, Tb, and Dy in the T poor phase; and the respective units of [T] and [R] in Formula 1, Formula 2, and Formula 3 are atom %, $$0.30 \leq (S1+S2)/(S1+S2+S3) \leq 0.80 \quad (4)$$

$$0.20 \leq S2/(S1+S2) \leq 0.80 \quad (5)$$

wherein S1 in Formula 4 and Formula 5 represents the sum of the areas of the first T rich phase exposed at a cross-section of the R-T-B based permanent magnet; S2 in Formula 4 and Formula 5 represents the sum of the areas of the second T rich phase exposed at the cross-section of the R-T-B based permanent magnet; and S3 in Formula 4 represents the sum of the areas of the T poor phase exposed at the cross-section of the R-T-B based permanent magnet.

The R-T-B based permanent magnet may comprise a grain boundary multiple junction surrounded by three or more main phase grains, as the grain boundaries, and both the second T rich phase and the T poor phase may exist within one grain boundary multiple junction.

The R-T-B based permanent magnet may be composed of 29.50% to 33.00% by mass of R, 0.70% to 0.95% by mass of B, 0.03% to 0.60% by mass of Al, 0.01% to 1.50% by mass of Cu, 0.00% to 3.00% by mass of Co, 0.10% to 1.00% by mass of Ga, 0.05% to 0.30% by mass of C, 0.03 to 0.40% by mass of O, and the balance, and the balance may be Fe only, or Fe and other elements.

The sum of the contents of heavy rare earth elements in the R-T-B based permanent magnet may be from 0.00% by mass to 1.00% by mass.

The T poor phase may contain at least one of Cu and Ga.

According to the present invention, an R-T-B based permanent magnet having high coercivity at high temperature even in a case in which the content of a heavy rare earth element in the R-T-B based permanent magnet is small, can be provided.

DETAILED DESCRIPTION

Figure 1A:
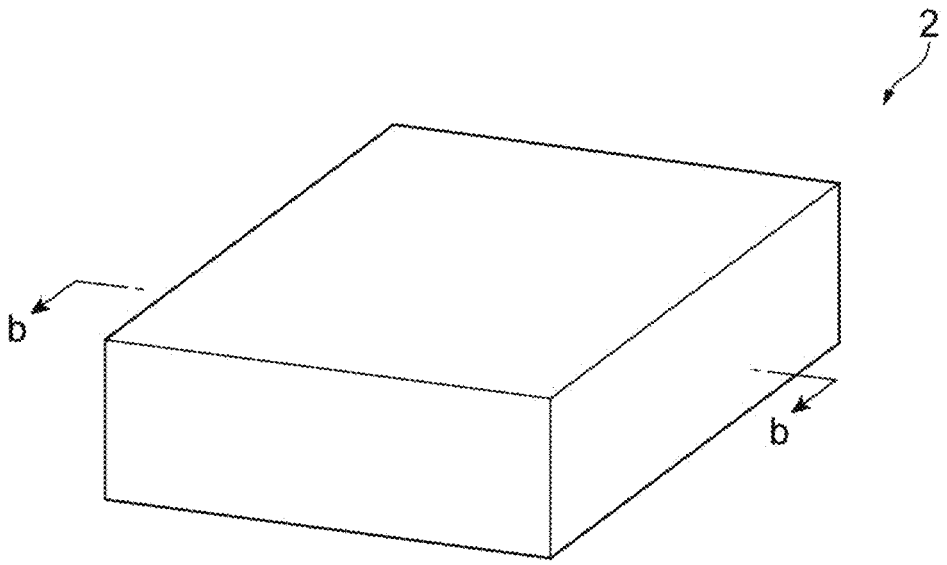
FIG. 1A is a schematic perspective view of an R-T-B based permanent magnet according to an embodiment of the present invention.

Hereinafter, suitable embodiments of the present invention will be described with reference to the drawings. In the drawings, equivalent constituent elements will be assigned with equivalent reference numerals. The present invention is not intended to be limited to the following embodiments. The term "permanent magnet" described below means an "R-T-B based permanent magnet" in all cases. The term "concentration" (unit: atom %) described below may be replaced with the term "content".

(Permanent Magnet)

The permanent magnet according to the present embodiment includes at least a rare earth element (R), a transition metal element (T), boron (B), and gallium (Ga).

The permanent magnet includes at least neodymium (Nd) as the rare earth element R. The permanent magnet may further contain another rare earth element R in addition to Nd. The other rare earth element R may be at least one selected from the group consisting of scandium (Sc), yttrium (Y), lanthanum (La), cerium (Ce), praseodymium (Pr), samarium (Sm), europium (Eu), gadolinium (Gd), terbium (Tb), dysprosium (Dy), holmium (Ho), erbium (Er), thulium (Tm), ytterbium (Yb), and lutetium (Lu).

The permanent magnet includes at least iron (Fe) as the transition metal element T. The permanent magnet may include both Fe and cobalt (Co) as the transition metal element T.

Figure 1B:
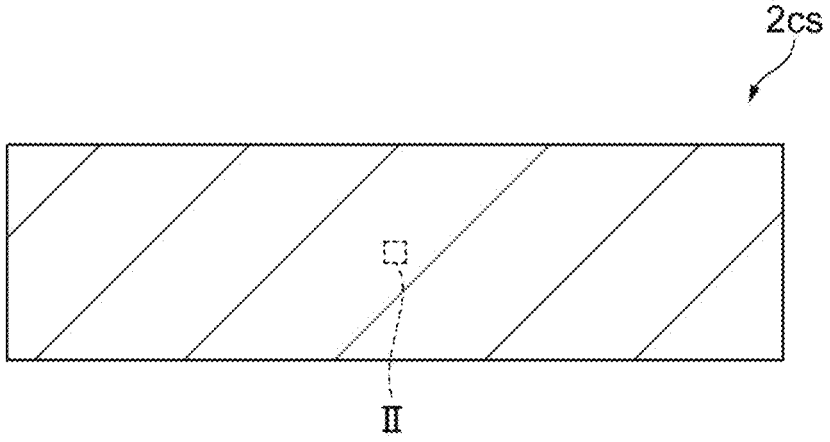
FIG. 1B is a schematic view (arrow view in the direction of line b-b) of a cross-section of the R-T-B based permanent magnet illustrated in FIG. 1A.
Figure 2:
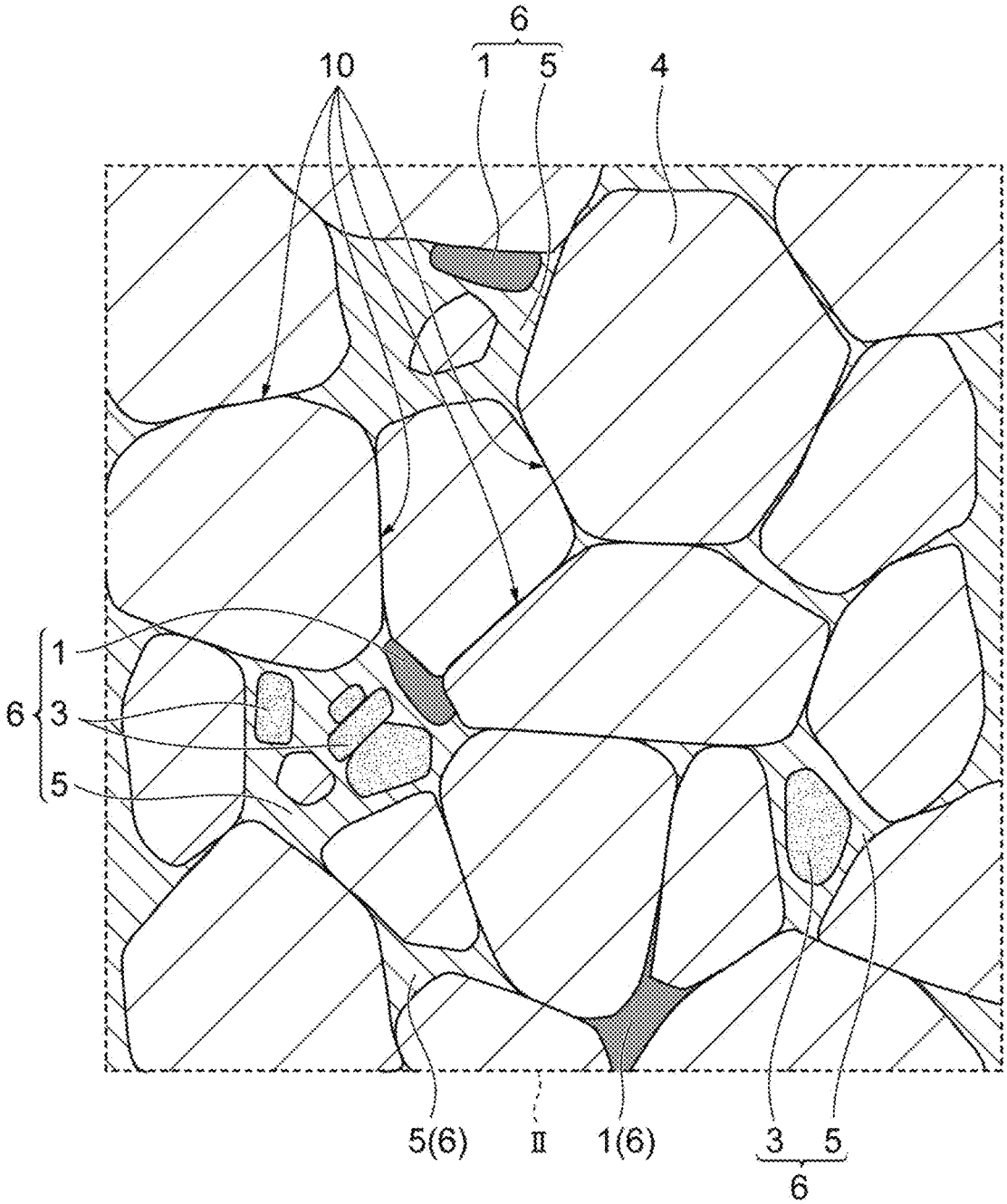
FIG. 2 is a schematic magnified view of a portion (region II) of a cross-section of the R-T-B based permanent magnet illustrated in FIG. 1B.

FIG. 1A is a schematic perspective view of a rectangular parallelepiped permanent magnet 2 according to the present embodiment, FIG. 1B is a schematic view of a cross-section 2*cs* of the permanent magnet 2, and FIG. 2 is a magnified view of a portion (region II) of the cross-section 2*cs* of the permanent magnet 2. The shape of the permanent magnet 2 is not limited to a rectangular parallelepiped. For example, the shape of the permanent magnet 2 may be, for example, a cube, a rectangular shape (plate), a polygonal prism, an arc segment, a fan, an annular sector, a sphere, a disc, a round column, a cylinder, a ring, or a capsule. The shape of the cross-section of the permanent magnet 2 may be, for example, a polygon, a circular arc (circular chord), a bow shape, an arch shape, a letter C shape, or a circle.

As illustrated in FIG. 2, the permanent magnet 2 comprises a plurality (a large number) of main phase grains 4. The main phase grains 4 contain at least Nd, T, and B. The main phase grains 4 may contain crystals of $R_2T_{14}B$. The crystal of $R_2T_{14}B$ may be a single crystal or a polycrystal. The main phase grains 4 may be composed of crystals of $R_2T_{14}B$ only. $R_2T_{14}B$ may be represented by, for example, $(Nd_{1-x}Pr_x)_2(Fe_{1-y}Co_y)_{14}B$, x may be 0 or more and less than 1, and y may be 0 or more and less than 1. The main phase grains 4 may contain another element in addition to Nd, T, and B. The composition in the main phase grains 4 may be uniform. The composition in the main phase grains 4 may also be non-uniform. For example, the respective concentration distributions of Nd, T, and B in the main phase grains 4 may have a gradient.

The permanent magnet 2 comprises grain boundaries surrounded by a plurality of the main phase grains 4. The permanent magnet 2 may also comprise a plurality (a large number) of grain boundaries. The permanent magnet 2 may also comprise a grain boundary multiple junction 6 as the grain boundary. A grain boundary multiple junction 6 is a grain boundary surrounded by three or more main phase grains 4. The permanent magnet 2 may comprise a plurality (a large number) of grain boundary multiple junctions 6. The permanent magnet 2 may also comprise a two-grain boundary 10 as the grain boundary. A two-grain boundary 10 is a grain boundary positioned between two main phase grains 4 that are adjacent to each other. The permanent magnet 2 may also comprise a plurality (a large number) of two-grain boundaries 10.

As described below, regarding the types of the grain boundary phase, a first T rich phase 1, a second T rich phase 3, and a T poor phase 5 exist.

At least a portion of the grain boundaries contains a first T rich phase 1. The grain boundary multiple junctions 6 may contain the first T rich phase 1. The two-grain boundaries 10 may contain the first T rich phase 1. The first T rich phase 1 is a phase that contains Nd, Ga, and at least one of Fe and Co and satisfies the following Formula 1 or Formula 1a. [T] in Formula 1 and Formula 1a represents the sum of the concentrations of Fe and Co in the first T rich phase 1. [R] in Formula 1 and Formula 1 a represents the sum of the concentrations of Nd, Pr, Th, and Dy in the first T rich phase 1. The respective units of [T] and [R] in Formula 1 and Formula 1 a are atom %. The first T rich phase 1 may contain only one of Fe and Co as T. The first T rich phase 1 may also contain both Fe and Co as T. The first T rich phase 1 may contain Nd only as R. The first T rich phase 1 may also contain at least one selected from the group consisting of Pr, Th, and Dy, in addition to Nd, as R. The first T rich phase may be a phase containing $R_6T_{13}Ga$. The first T rich phase 1 may also be a phase composed only of $R_6T_{13}Ga$. $R_6T_{13}Ga$ may be, for example, $Nd_6Fe_{13}Ga$.

$$1.7 \leq [T]/[R] \leq 3.0 \quad (1)$$

$$1.7 \leq [T]/[R] \leq 2.4 \quad (1a)$$

At least a portion of the grain boundaries contains a second T rich phase 3. The grain boundary multiple junctions 6 may contain the second T rich phase 3. There is a tendency that the second T rich phase 3 is hardly formed in the two-grain boundaries 10; however, a portion of the two-grain boundaries 10 may contain the second T rich phase 3. The second T rich phase 3 is a phase that contains Nd, Ga, and at least one of Fe and Co and satisfies the following Formula 2 or Formula 2a. [T] in Formula 2 and Formula 2a represents the sum of the concentrations of Fe and Co in the second T rich phase 3. [R] in Formula 2 and Formula 2a represents the sum of the concentrations of Nd, Pr, Tb, and Dy in the second T rich phase 3. The respective units of [T] and [R] in Formula 2 and Formula 2a are atom %. The second T rich phase 3 may contain only one of Fe and Co as T. The second T rich phase 3 may contain both Fe and Co as T. The second T rich phase 3 may contain Nd only as R. The second T rich phase 3 may contain at least one selected from the group consisting of Pr, Tb, and Dy, in addition to Nd, as R.

$$0.8 \leq [T]/[R] \leq 1.5 \quad (2)$$

$$0.9 \leq [T]/[R] \leq 1.4 \quad (2a)$$

At least a portion of the grain boundaries contains a T poor phase 5. The grain boundary multiple junctions 6 may contain the T poor phase 5, and the two-grain boundaries 10 may contain the T poor phase 5. The T poor phase 5 is a phase that contains Nd and satisfies the following Formula 3 or Formula 3a. [T] in Formula 3 and Formula 3a represents the sum of the concentrations of Fe and Co in the T poor phase 5. [R] in Formula 3 and Formula 3a represents the sum of the concentrations of Nd, Pr, Tb, and Dy in the T poor phase 5. The respective units of [T] and [R] in Formula 3 and Formula 3a are atom %. The T poor phase 5 may not contain both of Fe and Co as T. The T poor phase 5 may contain only one of Fe and Co as T. The T poor phase 5 may contain both Fe and Co as T. The T poor phase 5 may contain Nd only as R. The T poor phase 5 may contain at least one selected from the group consisting of Pr, Tb, and Dy, in addition to Nd, as R. The T poor phase 5 may not contain Ga. The T poor phase 5 may contain Ga. The T poor phase 5 may contain O. The T poor phase 5 may not contain O. The T poor phase 5 may be a phase that satisfies Formula 3 or Formula 3a and satisfies the following Formula 4. [O] in Formula 4 represents the concentration of O in the T poor phase 5, [R] in Formula 4 represents the sum of the concentrations of Nd, Pr, Tb, and Dy in the T poor phase 5, and the respective units of [O] and [R] in Formula 4 are atom %.

$$0.0 \leq [T]/[R] \leq 0.6 \quad (3)$$

$$0.2 \leq [T]/[R] \leq 0.4 \quad (3a)$$

$$0.0 \leq [O]/[R] \leq 0.35 \quad (4)$$

Figure 4:
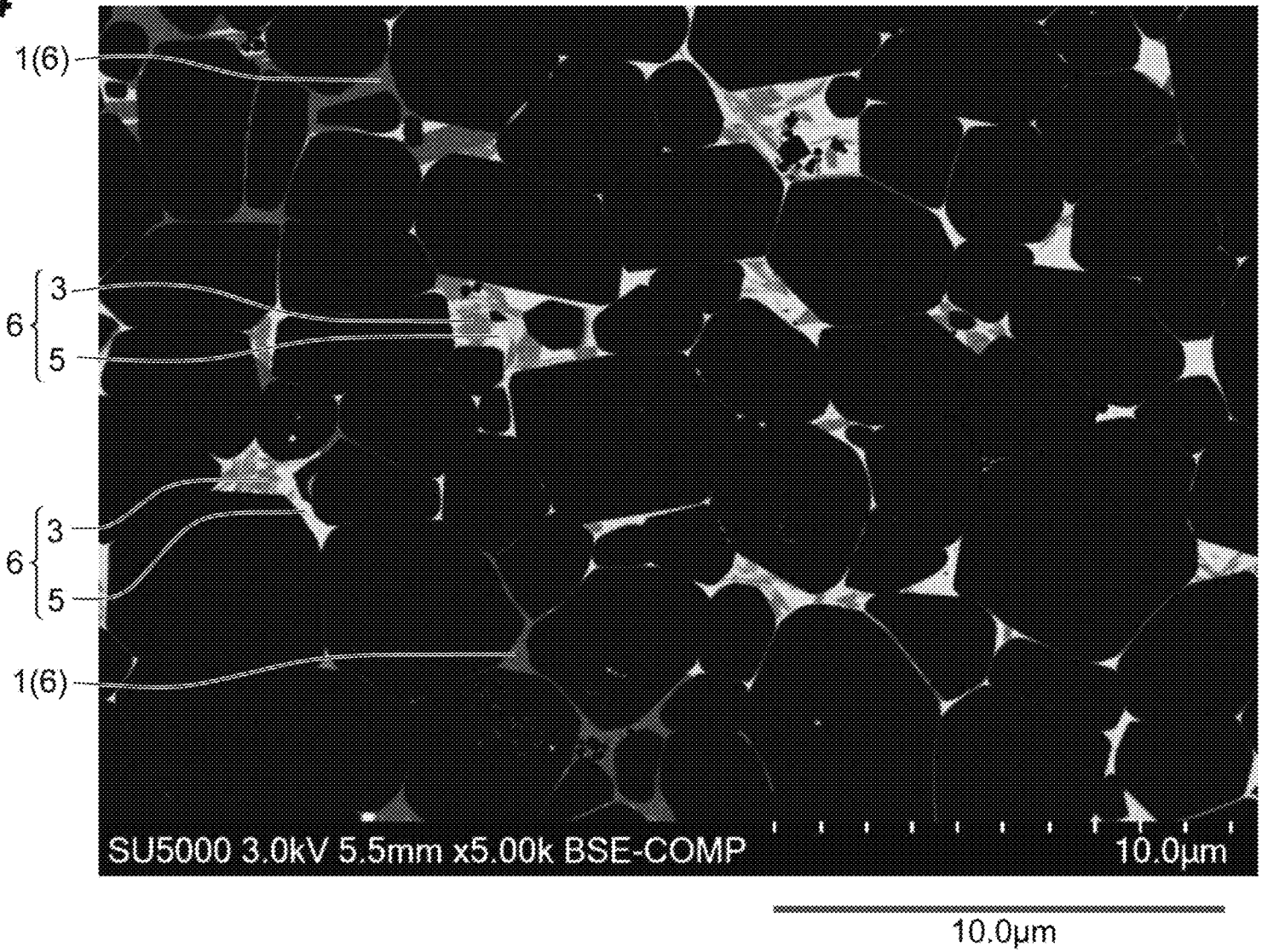
FIG. 4 is an image captured with a scanning electron microscope, showing a portion of a cross-section of the R-T-B based permanent magnet of Example 3 of the present invention.

The first T rich phase 1, the second T rich phase 3, and the T poor phase 5 are completely different phases that are objectively and clearly identified on the basis of the difference in the composition. As shown in FIG. 4, the first T rich phase 1, the second T rich phase 3, and the T poor phase 5 are identified on the basis of the contrast (difference in the light and shade) in an image of a cross-section of the permanent magnet captured by scanning electron microscopy (SEM). A dark part in FIG. 4 is a cross-section of a main phase grain.

As the permanent magnet 2 contains the first T rich phase 1 and the second T rich phase 3 as the grain boundary phase, the permanent magnet 2 can have high coercivity at room temperature and a high temperature. The term room temperature may be, for example, from 0° C. to 40° C. The term high temperature may be, for example, from 100° C. to 200° C. The reason why coercivity increases due to the inclusion of the first T rich phase 1 and the second T rich phase 3 is as follows. However, the reason why coercivity increases is not limited to the following mechanism.

During the production process (sintering step and aging treatment step) for the permanent magnet 2, the first T rich phase 1 is formed. Despite that the first T rich phase 1 contains a large amount of T (for example, Fe) compared to other grain boundary phases, magnetization of the first T rich phase 1 is low compared to conventional grain boundary phases. T in a grain boundary phase that is in contact with the first T rich phase 1 is consumed for the formation of the first T rich phase 1. That is, along with the formation of the first T rich phase 1, the concentration of T in the T poor phase 5 is reduced. As a result, magnetization of the T poor phase 5 is also reduced. As the first T rich phase I and the T poor phase 5, both of which have low magnetization, are present between two or more main phase grains 4 (crystalline grains of $R_2T_{14}B$) that are adjacent to each other, the magnetic bond between the main phase grains 4 is decoupled. That is, two or more crystalline grains of $R_2T_{14}B$ adjacent to each other are separated from each other, with a grain boundary having low magnetization interposed therebetween. As the permanent magnet 2 includes the first T rich phase 1 for the reason described above, the coercivity of the permanent magnet 2 at room temperature and high temperature is enhanced.

It is suspected that the second T rich phase 3 is precipitated out within the grain boundaries in association with cooling of a sintered body, after an aging treatment step subsequent to a sintering step is completed. When the second T rich phase 3 is precipitated, the second T rich phase 3 deprives Fe from the T poor phase 5 around the second T rich phase 3. That is, along with the precipitation of the second T rich phase 3, the concentration of Fe in the T poor phase 5 is further decreased. As a result, the magnetization of the T poor phase 5 is further decreased compared to the T poor phase before the precipitation of the second T rich phase 3. Therefore, as the second T rich phase 3 is formed, the magnetization of the T poor phase 5 positioned between main phase grains 4 is further decreased. As a result, the magnetic bond between the main phase grains 4 is decoupled. That is, two or more crystalline grains of $R_2T_{14}B$ adjacent to each other are separated from each other, with the T poor phase 5 having low magnetization interposed therebetween. As the permanent magnet 2 includes a second T rich phase 3 and a T poor phase 5 for the reason described above, the coercivity of the permanent magnet 2 at room temperature and high temperature is enhanced.

As described above, since the T poor phase 5 is easily formed around the second T rich phase 3, both the second T rich phase 3 and the T poor phase 5 are likely to exist within one grain boundary multiple junction 6. As both of the second T rich phase 3 and the T poor phase 5 exist within one grain boundary multiple junction 6, the coercivity of the permanent magnet at room temperature and high temperature is likely to be enhanced. For the same reason, only the second T rich phase 3 and the T poor phase 5 may exist within one grain boundary multiple junction 6. That is, one grain boundary multiple junction 6 may be composed only of the second T rich phase 3 and the T poor phase 5.

The first T rich phase 1, the second T rich phase 3, and the T poor phase 5 may exist within one grain boundary multiple junction 6. One grain boundary multiple junction 6 may be composed only of the first T rich phase 1, the second T rich phase 3, and the T poor phase 5. Both the first T rich phase 1 and the T poor phase 5 may exist within one grain boundary multiple junction 6. One grain boundary multiple junction 6 may be composed only of the first T rich phase 1 and the T poor phase 5. Only the first T rich phase 1 among the first T rich phase 1, second T rich phase 3, and T poor phase 5 may exist within one grain boundary multiple junction 6. One grain boundary multiple junction 6 may be composed only of the first T rich phase 1. Only the T poor phase 5 among the first T rich phase 1, second T rich phase 3, and T poor phase 5 may exist within one grain boundary multiple junction 6. One grain boundary multiple junction 6 may be composed only of the T poor phase 5. As the permanent magnet 2 contains these grain boundary multiple junctions 6, the coercivity of the permanent magnet 2 at room temperature and high temperature is likely to be enhanced. The grain boundaries may also contain another phase different from the first T rich phase 1, the second T rich phase 3, and the T poor phase 5. The other phase may be, for example, carbide of Zr or Ti, or boride of Zr or Ti.

At least a portion of the T poor phase 5 may contain at least one of copper (Cu) and Ga. In a case in which the T poor phase 5 contains at least one of Cu and Ga, the coercivity of the permanent magnet 2 at room temperature and high temperature is likely to be enhanced. For example, in a case in which the permanent magnet 2 contains Cu, the T poor phase 5 is also likely to contain Cu. In a cooling process for a sintered body, in a case in which a portion of Ga in the initial grain boundary phase remains without being consumed for the precipitation of the second T rich phase 3, the T poor phase 5 is likely to contain Ga.

The first T rich phase 1, the second T rich phase 3, and the T poor phase 5 satisfy the following Formula 4 or Formula 4a, and the first T rich phase 1 and the second T rich phase 3 satisfy the following Formula 5 or Formula 5a. S1 in Formula 4, Formula 4a, Formula 5, and Formula 5a is the sum of the areas of the first T rich phase 1 exposed at a cross-section 2*cs* of the permanent magnet 2. S2 in Formula 4, Formula 4a, Formula 5, and Formula 5a is the sum of the areas of the second T rich phase 3 exposed at a cross-section 2*cs* of the permanent magnet 2. S3 in Formula 4 and Formula 4a is the sum of the areas of the T poor phase 5 exposed at a cross-section 2*cs* of the permanent magnet 2.

$$0.30 \leq (S1+S2)/(S1+S2+S3) \leq 0.80 \quad (4)$$

$$0.35 \leq (S1+S2)/(S1+S2+S3) \leq 0.77 \quad (4a)$$

$$0.20 \leq S2/(S1+S2) \leq 0.80 \quad (5)$$

$$0.25 \leq S2/(S1+S2) \leq 0.77 \quad (5a)$$

As (S1+S2)/(S1+S2+S3) is 0.30 or more, the coercivity of the permanent magnet 2 at high temperature is high. As (S1+S2)/(S1+S2+S3) is 0.80 or less, the permanent magnet 2 can have a high residual magnetic flux density and high coercivity at room temperature. As S2/(S1+S2) is 0.20 or more, the coercivity of the permanent magnet 2 at high temperature is high. In a case in which S2/(S1+S2) is less than 0.20, since the amount of the first T rich phase 1 is relatively too much, the coercivity at room temperature is low. In a case in which the amount of the first T rich phase I is relatively too large, the residual magnetic flux density tends to be low. It is because T in the main phase grains 4 (crystalline grains of $R_2T_{14}B$) is consumed excessively for the formation of the first T rich phase 1, and the volume ratio of the main phase grains 4 is reduced. As S2/(S1+S2) is 0.80 or less, the coercivity of the permanent magnet 2 at high temperature is high. In a case in which S2/(S1+S2) is more than 0.80, since the amount of the first T rich phase 1 is relatively too small, the coercivity of the permanent magnet 2 at room temperature and high temperature is low. It is because the amount of thick two-grain boundaries 10 formed from the first T rich phase 1 is small, and adjacent main phase grains 4 are not sufficiently magnetically separated by the two-grain boundaries 10. In a case in which S2/(S1+S2) is larger than 0.80, the residual magnetic flux density is also low.

The mechanism by which the permanent magnet 2 has a high residual magnetic flux density and high coercivity at room temperature is not limited to the mechanism described above.

Figure 5A:
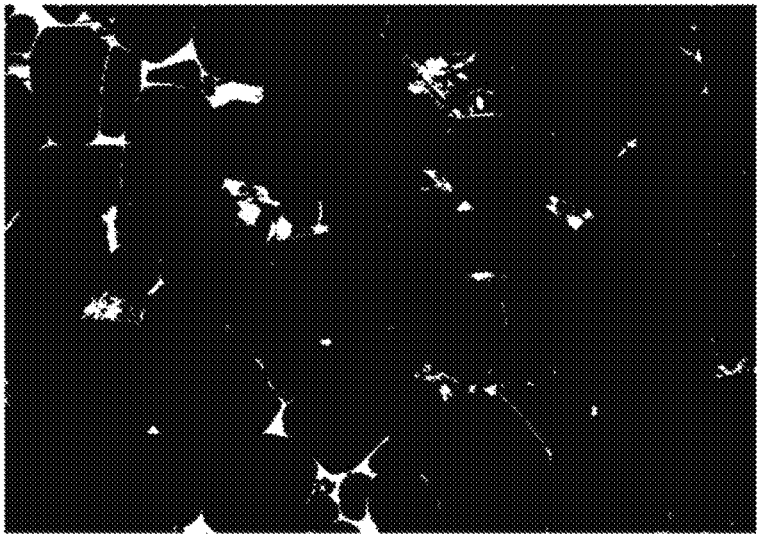
FIG. 5A is an image showing the first T rich phase and the second T rich phase exposed at the cross-section shown in FIG. 4.
Figure 5B:
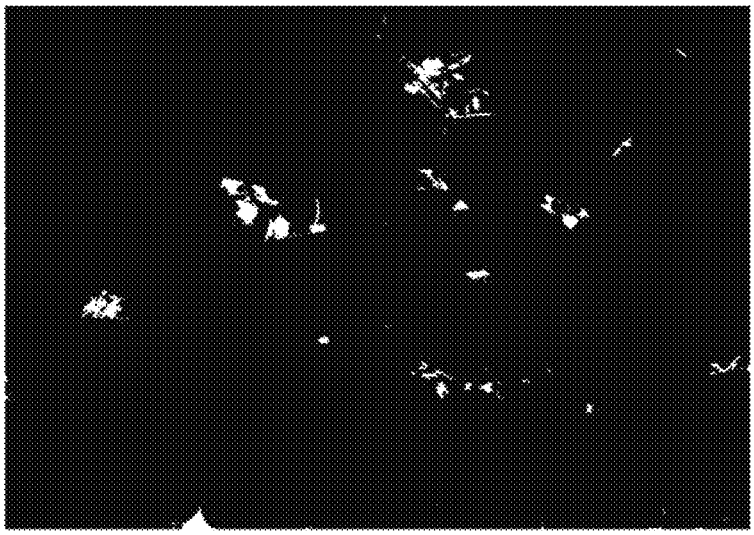
FIG. 5B is an image showing the second T rich phase exposed at the cross-section shown in FIG. 4.
Figure 5C:
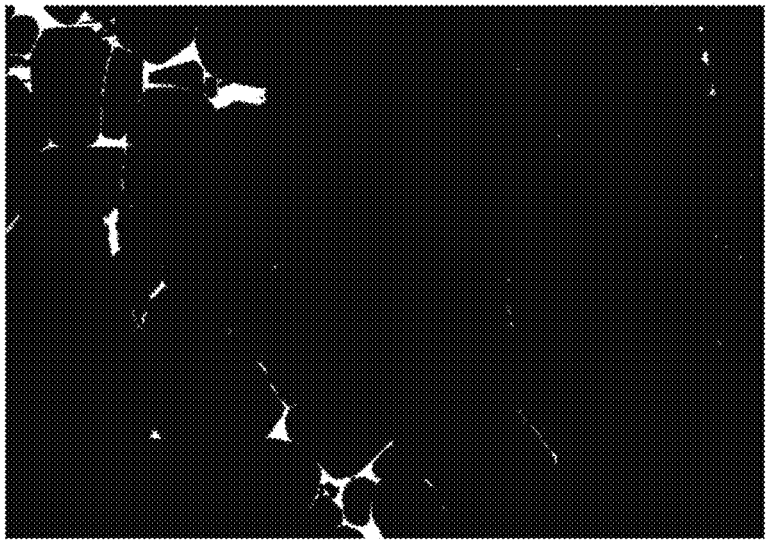
FIG. 5C is an image showing the first T rich phase exposed at the cross-section shown in FIG. 4.

For the measurement of S1, S2, and S3, an image of the cross-section 2*cs* of the permanent magnet 2 is captured by SEM. An image of a portion of the cross-section 2*cs* of the permanent magnet 2 is shown in FIG. 4. As shown in FIG. 4, the first T rich phase 1, the second T rich phase 3, and the T poor phase 5 are identified on the basis of the contrast (difference in the light and shade) in a backscattered electron image captured by SEM. Parts having equal brightness are regarded as the same phase. Therefore, by trinarizing the grain boundary phase exposed at the cross-section 2*cs* of the permanent magnet 2 on the basis of the brightness of the backscattered electron image, the respective areas of the first T rich phase 1, the second T rich phase 3, and the T poor phase 5 can be measured. The main phase grains 4 and the grain boundary phase are also identified on the basis of the contrast (difference in the light and shade) in the backscattered electron image. FIG. 5B and FIG. 5C are images obtained by trinarization of the grain boundary phase shown in FIG. 4. A white region in FIG. 5B is the second T rich phase 3. A white region in FIG. 5C is the first T rich phase 1. FIG. 5A also corresponds to the cross-section shown in FIG. 4. A white region in FIG. 5A is the first T rich phase 1 and the second T rich phase 3. Trinarization of the grain boundary phase may be carried out manually. Trinarization of the grain boundary phase may also be carried out using an image analysis software program. The respective measurements of S1, S2, and S3 may be carried out using an image analysis software program. As the image analysis software program, for example, Mac-View manufactured by Mountech Co., Ltd. may also be used. S1, S2, and S3 may not be necessarily measured over the entire cross-section 2*cs* of the permanent magnet 2. That is, S1, S2, and S3 may be measured for any arbitrary portion of the cross-section 2*cs* of the permanent magnet 2.

The average grain size of the main phase grains 4 is not particularly limited; however, for example, the average grain size may be from 1.0 μm to 10.0 μm. The sum of the proportions of volume of the main phase grains 4 in the permanent magnet 2 is not particularly limited; however, for example, the sum may be 75% by volume or more and less than 100% by volume.

A permanent magnet 2 having the above-described technical features can have sufficiently high coercivity at high temperature even in a case in which the permanent magnet 2 does not include a heavy rare earth element. However, in order to further increase the coercivity of the permanent magnet 2 at high temperature, the permanent magnet 2 may include a heavy rare earth element. However, in a case in which the content of the heavy rare earth element is too large, the residual magnetic flux density tends to decrease. For example, the sum of the contents of heavy rare earth elements in the permanent magnet 2 may be from 0.00% by mass to 1.00% by mass. By avoiding the use of heavy rare earth elements as far as possible, the resources risk brought by using heavy rare earth elements can be reduced. The heavy rare earth element may be at least one selected from the group consisting of gadolinium (Gd), terbium (Tb), dysprosium (Dy), holmium (Ho), erbium (Er), thulium (Tm), ytterbium (Yb), and lutetium.

The respective compositions of the main phase grains 4 and the grain boundary phase described above may be specified by analyzing a cross-section 2*cs* of the permanent magnet 2 using an energy dispersive X-ray spectrometer (EDS).

The overall specific composition of the permanent magnet 2 will be described below. However, the range of the composition of the permanent magnet 2 is not limited to the following. As long as the effect of the present invention attributed to the composition and area of the grain boundary phases mentioned above is obtained, the composition of the permanent magnet 2 may be out of the following composition range.

The content of R in the permanent magnet may be 29.50% to 33.00% by mass. In a case in which the permanent magnet contains a heavy rare earth element as R, the content of the sum of all the rare earth elements also containing heavy rare earth elements is desirably 29.5% to 33% by mass. When the content of R is in this range, the residual magnetic flux density and coercivity tend to increase. In a case in which the content of R is too small, main phase grains ($R_2T_{14}B$) are hardly formed, and an a-Fe phase having soft magnetic properties is likely to be formed. As a result, the coercivity tends to decrease. On the other hand, in a case in which the content of R is too large, the volume ratio of the main phase grains is lowered, and the residual magnetic flux density tends to decrease. From the viewpoint that the volume ratio of the main phase grains becomes high, and the residual magnetic flux density is likely to become high, the content of R may be 30.00% to 32.50% by mass. From the viewpoint that the residual magnetic flux density and coercivity are likely to increase, the sum of the proportions occupied by Nd and Pr in all of the rare earth elements R may be 80 atom % to 100 atom %, or 95 atom % to 100 atom %.

The content of B in the permanent magnet may be 0.70% to 0.95% by mass. When the content of B is smaller than the stoichiometric ratio of the composition of the main phase represented by $R_2T_{14}B$, the first T rich phase I and the second T rich phase 3 are likely to be formed, and coercivity is likely to be enhanced. In a case in which the content of B is too small, an $R_2T_{17}$ phase is likely to be precipitated, and the coercivity tends to decrease. On the other hand, in a case in which the content of B is too large, it is difficult for the first T rich phase 1 and the second T rich phase 3 to be sufficiently formed, and the coercivity tends to decrease. From the viewpoint that the residual magnetic flux density and coercivity are likely to increase, the content of B may be 0.75% to 0.90% by mass, or 0.80% to 0.88% by mass.

The permanent magnet may include aluminum (Al). The content of Al in the permanent magnet may be 0.03% to 0.60% by mass, or 0.03% to 0.30% by mass or less. When the content of Al is in the above-described range, the coercivity and corrosion resistance of the permanent magnet are likely to be enhanced.

The content of Cu in the permanent magnet may be 0.01% to 1.50% by mass, or 0.03% to 1.00% by mass, or 0.05% to 0.50% by mass. When the content of Cu is in the above-described range, the coercivity, corrosion resistance, and temperature characteristics of the permanent magnet are likely to be enhanced. From the viewpoint that the coercivity at room temperature and high temperature is likely to increase, the content of Cu may be 0.01% to 0.50% by mass.

The content of Co in the permanent magnet may be 0.00% to 3.00% by mass. Co may be a transition metal element T that constitutes the main phase grains (crystalline grains of $R_2T_{14}B$), similarly to Fe. As the permanent magnet contains Co, the Curie temperature of the permanent magnet is likely to increase, and as the permanent magnet contains Co, the corrosion resistance of the grain boundary phase is likely to be enhanced, while the corrosion resistance of the permanent magnet as a whole is likely to be enhanced. From the viewpoint that these effects can be easily obtained, the content of Co in the permanent magnet may be 0.30% to 2.50% by mass.

The content of Ga may be 0.10% to 1.00% by mass, or 0.20% to 0.80% by mass. In a case in which the content of Ga is too small, the first T rich phase 1 and the second T rich phase 3 are not sufficiently formed, and the coercivity tends to decrease. In a case in which the content of Ga is too large, the first T rich phase 1 and the second T rich phase 3 are excessively formed, the volume ratio of the main phase is deceased, and the residual magnetic flux density tends to decrease. From the viewpoint that the residual magnetic flux density and coercivity are likely to increase, the content of Ga may be 0.20% to 0.80% by mass.

The permanent magnet may include carbon (C). The content of C in the permanent magnet may be 0.05% to 0.30% by mass, or 0.10% to 0.25% by mass. In a case in which the content of C is too small, an $R_2T_{17}$ phase is likely to be precipitated out, and the coercivity tends to decrease. In a case in which the content of C is too large, the first T rich phase I and the second T rich phase 3 are not sufficiently formed, and the coercivity tends to decrease. From the viewpoint that the coercivity is likely to be enhanced, the content of C may be 0.10% to 0.25% by mass.

The content of O in the permanent magnet may be 0.03% to 0.40% by mass. In a case in which the content of O is too small, the corrosion resistance of the permanent magnet tends to be reduced, and in a case in which the content of O is too large, the coercivity tends to be decreased. From the viewpoint that corrosion resistance and coercivity are likely to be enhanced, the content of O may be 0.05% to 0.30% by mass, or 0.05% to 0.25% by mass.

The permanent magnet may include nitrogen (N). The content of N in the permanent magnet may be 0.00% to 0.15% by mass. In a case in which the content of N is too large, the coercivity tends to decrease.

The balance obtained by excluding the above-mentioned elements from the permanent magnet may be Fe only, or Fe and other elements. In order for the permanent magnet to have sufficient magnetic characteristics, the sum of the contents of elements other than Fe in the balance may be 5% by mass or less with respect to the total mass of the permanent magnet.

The permanent magnet may also include zirconium (Zr). The content of Zr in the permanent magnet may be 0.00% to 1.50% by mass, or 0.03% to 0.80% by mass, or 0.10% to 0.60% by mass. Zr suppresses abnormal grain growth of the main phase grains (crystalline grains) in the production process (sintering step) for the permanent magnet, makes the texture of the permanent magnet uniform and fine, and enhances the magnetic characteristics of the permanent magnet.

The permanent magnet may include titanium (Ti). The content of Ti in the permanent magnet may be 0.00% to 1.50% by mass, or 0.03% to 0.80% by mass, or 0.10% to 0.60% by mass. Ti suppresses abnormal grain growth of the main phase grains (crystalline grains) in the production process (sintering step) for the permanent magnet, makes the texture of the permanent magnet uniform and fine, and enhances the magnetic characteristics of the permanent magnet.

The permanent magnet may include at least one selected from the group consisting of manganese (Mn), calcium (Ca), nickel (Ni), silicon (Si), chlorine (Cl), sulfur (S), and fluorine (F), as unavoidable impurities. The sum of the contents of the unavoidable impurities in the permanent magnet may be 0.001% to 0.50% by mass.

The above-described composition of the permanent magnet as a whole may be specified according to, for example, an X-ray fluorescence (XRF) analysis method, a high-frequency inductively coupled plasma (ICP) emission analysis method, and an inert gas fusion-non-dispersive type infrared absorption (NDIR) method.

The permanent magnet according to the present embodiment may be applied to a motor, an actuator, or the like. For example, the permanent magnet is utilized in various fields such as hybrid cars, electric cars, hard disk drives, magnetic resonance imaging apparatuses (MRI), smart phones, digital cameras, slim-type TVs, scanners, air-conditioners, heat pumps, refrigerators, vacuum cleaners, washing and drying machines, elevators, and wind power generators.

(Method for Producing Permanent Magnet)

A method for producing the above-described permanent magnet will be explained below.

A raw material alloy is produced from metals (raw material metals) containing various elements that constitute the permanent magnet described above. The raw material alloy may be produced according to a strip casting method. The raw material metal may be, for example, a simple substance of a rare earth element (simple substance of metal), an alloy containing a rare earth element, pure iron, ferroboron, or an alloy containing these. These raw material metals are weighed so as to approximately match the desired composition of the permanent magnet.

As the raw material alloy, a main phase alloy and a grain boundary phase alloy may be used. That is, the permanent magnet may be produced according to a two-alloy method. The main phase grains contained in the permanent magnet originate from a powder of the main phase alloy. The grain boundaries contained in the permanent magnet originate from a powder of the grain boundary phase alloy. However, the composition of the main phase grains contained in the permanent magnet is not necessarily consistent with the composition of the main phase alloy, and the composition of the grain boundary phase contained in the permanent magnet is not necessarily consistent with the composition of the grain boundary phase alloy. It is because in the sintering step and the aging treatment step that will be described below, the respective compositions of the main phase alloy and the grain boundary phase alloy may change.

The grain boundary phase alloy may also contain B for the following reason.

In the production process for the permanent magnet, a green compact formed from the respective powders of the main phase alloy and the grain boundary phase alloy is sintered. In order to obtain the permanent magnet according to the present embodiment, it is preferable that the green compact is sintered over a long time period at a low temperature. The low temperature is from 960° C. to 990° C. The long time period is from 72 hours to 200 hours. In a case in which the grain boundary phase alloy contains B, transfer or exchange of elements between the main phase alloy and the grain boundary phase alloy can easily proceed at low temperature, and melting of the various alloys at low temperature and precipitation of $R_2T_{14}B$ and the grain boundary phase are promoted. Therefore, in a case in which the grain boundary phase alloy contains B, even if the sintering temperature of the green compact is a low temperature, a compact sintered body is likely to be formed. In a case in which the grain boundary phase alloy contains B, it is desirable that the content of B in the main phase alloy is smaller than the content of B in a conventional main phase alloy. In a case in which the grain boundary phase alloy contains B, it is desirable that the grain boundary phase alloy does not contain Zr and Ti. In a case in which the grain boundary phase alloy contains B, Zr, and Ti, because B in the grain boundary phase alloy is easily bonded to Zr and Ti, $R_2T_{14}B$ is hardly formed, and the coercivity and residual magnetic flux density of the permanent magnet are likely to be reduced. The content of B in the grain boundary phase alloy may be 0.1% to 0.3% by mass. In a case in which the content of B is less than 0.1% by mass, the second T rich phase 3 is hardly formed. In a case in which the content of B is larger than 0.3% by mass, the squareness ratio (Hk/HcJ) of the permanent magnet is likely to be decreased.

The grain boundary phase alloy may contain Co. The content of Co in the grain boundary phase alloy may be 10% to 40% by mass. In a case in which the content of Co is less than 10% by mass, the second T rich phase 3 is hardly formed. In a case in which the content of Co is larger than 40% by mass, the squareness ratio (Hk/HcJ) at room temperature of the permanent magnet is likely to be decreased.

The various raw material alloys described above are pulverized, and thereby a raw material alloy powder is prepared. The raw material alloys may be pulverized in two stages of a coarsely pulverizing step and a finely pulverizing step. In the coarsely pulverizing step, hydrogen is stored in the raw material alloy. After the storage of hydrogen, the raw material alloy is dehydrogenated by heating. Through dehydrogenation, the raw material alloy is pulverized. The respective coarsely pulverizing steps for the main phase alloy and the grain boundary phase alloy may be individually carried out. The dehydrogenation temperature of the main phase alloy may be 300° C. to 400° C. In a case in which the dehydrogenation temperature of the main phase alloy is lower than 300° C., hydrogen is prone to remain in the main phase alloy, and during the sintering step, hydrogen in the sintered body is prone to cause cracks in the sintered body. In a case in which the dehydrogenation temperature of the main phase alloy is higher than 400° C., the second T rich phase 3 is hardly formed. The dehydrogenation temperature of the grain boundary phase alloy may be 500° C. to 600° C. In a case in which the dehydrogenation temperature of the grain boundary phase alloy is lower than 500° C., the second T rich phase 3 is hardly formed. In a case in which the dehydrogenation temperature of the grain boundary phase alloy is higher than 600° C., there is a possibility that the powder particles of the grain boundary phase alloy may be sintered together in the coarsely pulverizing step, and the grain boundary phase alloy is not sufficiently pulverized.

In the coarsely pulverizing step, the raw material alloy is pulverized until the particle size of the raw material alloy becomes about several hundred μm. In the finely pulverizing step that is subsequent to the coarsely pulverizing step, the raw material alloy is further pulverized until the average particle size becomes 3 to 5 μm. In the finely pulverizing step, for example, a jet mill may be used. The raw material alloy may not be pulverized in two stages of a coarsely pulverizing step and a finely pulverizing step. For example, only the finely pulverizing step may be carry out.

A powder of the main phase alloy and a powder of the grain boundary phase alloy are mixed at a predetermined ratio. The predetermined ratio is a ratio at which the overall composition of the mixture of the main phase alloy and the grain boundary phase alloy is approximately consistent with the composition of an intended permanent magnet. The raw material alloy powder described below means a mixture of the main phase alloy and the grain boundary phase alloy.

The raw material alloy obtained by the method described above is molded in a magnetic field, and thereby a green compact is obtained. For example, a green compact is obtained by placing a raw material alloy powder in a mold and pressing the raw material alloy powder with the mold while applying a magnetic field thereto. The pressure applied to the raw material alloy powder by the mold may be 30 MPa to 300 MPa. The strength of the magnetic field that is applied to the raw material alloy powder may be 950 kA/m to 1,600 kA/m.

Figure 3:
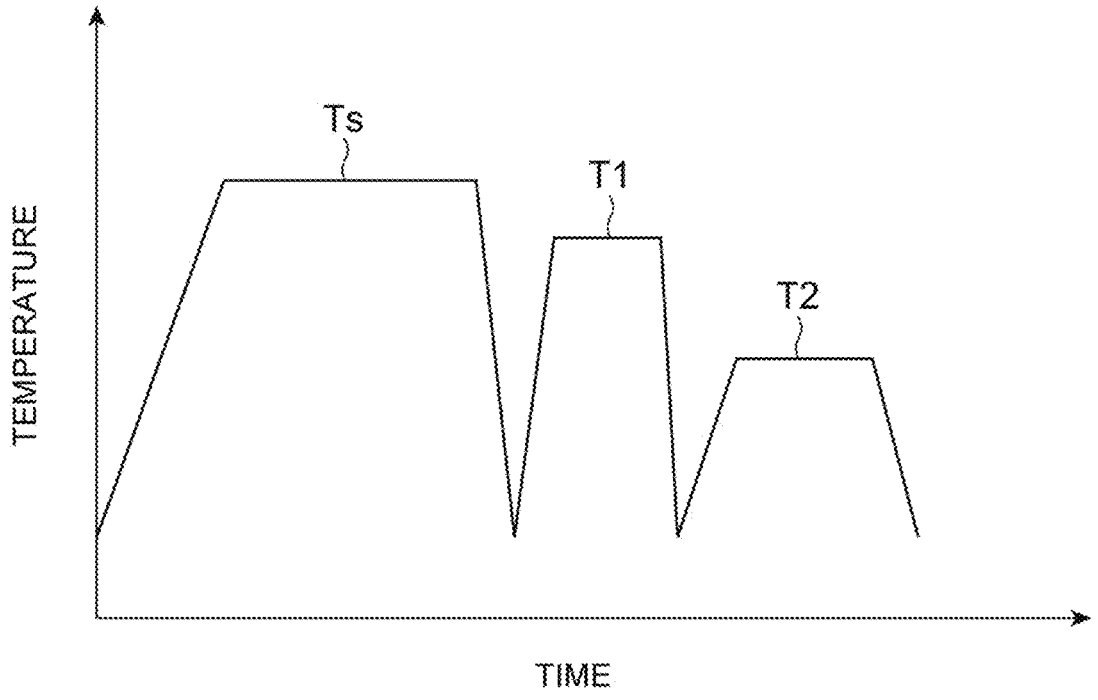
FIG. 3 is a schematic diagram illustrating a sintering step and an aging treatment step comprised by the method for producing an R-T-B based permanent magnet according to an embodiment of the present invention.

The characteristic grain boundary phase comprised by the permanent magnet according to the present embodiment may be formed by going through a two-stage aging treatment step that is subsequent to the sintering step as described below. The temperature profile over time of the sintering step and the aging treatment step is shown in FIG. 3. The details of the sintering step and the aging treatment step are as follows.

In the sintering step, the green compact described above is sintered in a vacuum or an inert gas atmosphere, and thereby a sintered body is obtained. The sintering conditions may be set appropriately according to the composition of the intended permanent magnet, the method for pulverizing the raw material alloy, the particle size, and the like. In order for S2/(S1+S2) to be from 0.20 to 0.80, the sintering temperature Ts may be 960° C. to 990° C., or 960° C. to 980° C. In a case in which the sintering temperature Ts is lower than 960° C., the second T rich phase 3 is likely to be excessively formed, and the value is S2/(S1+S2) is likely to exceed 0.80. In a case in which the sintering temperature Ts is higher than 990° C., the second T rich phase 3 is hardly formed, and the value of S2/(S1+S2) is likely to be less than 0.20. Since a sintering temperature Ts in the range of 960° C. to 990° C. is lower than the conventional sintering temperatures (for example, 1,000° C. to 1,100° C.), the green compact is hardly sintered. Therefore, in order to sinter the green compact sufficiently at a low sintering temperature Ts, the green compact is heated for a long time in the sintering step. In order to sinter the green compact sufficiently at a low sintering temperature Ts, the sintering time may be 72 to 200 hours.

The aging treatment step may be configured to include a first aging treatment and a second aging treatment that is subsequent to the first aging treatment. In the two-stage aging treatment step, the sintered body is heated in a vacuum or an inert gas atmosphere. As shown in FIG. 3, in the first aging treatment, the sintered body is heated at a first temperature T1. In the second aging treatment, the sintered body is heated at a second temperature T2. The first temperature T1 is higher than the second temperature T2.

The first temperature T1 may be 700° C. to 940° C., or 800° C. to 920° C. In a case in which the first temperature T1 is too low, the second T rich phase 3 is hardly formed, and the value of S2/(S1+S2) is likely to be less than 0.20. As a result, the coercivity at high temperature is reduced. In a case in which the first temperature T1 is too high, the second T rich phase 3 is hardly formed, the value of S2/(S1+S2) is likely to be less than 0.20, and the coercivity at high temperature is reduced.

The second temperature T2 may be 450° C. to 570° C., or 470° C. to 540° C. In a case in which the second temperature T2 is too low, the first T rich phase 1 and the second T rich phase 3 are hardly formed, and the value of (S1+S2)/(S1+S2+S3) is likely to be less than 0.30. As a result, the coercivity at high temperature is reduced. In a case in which the second temperature T2 is too high, the first T rich phase 1 and the second T rich phase 3 are likely to be excessively formed, and the value of (S1+S2)/(S1+S2+S3) is likely to exceed 0.80. As a result, the coercivity at high temperature is reduced.

As shown in FIG. 3, in a case in which the temperature of the atmosphere is raised from a temperature of lower than Ts (for example, room temperature) to Ts in order to initiate the sintering step, the rate of temperature increase may be 0.1 to 20° C./min. The "temperature of the atmosphere" is the temperature of the atmosphere around the sintered body, and is the temperature inside the heating furnace, for example. After the sintering step, in a case in which the temperature of the atmosphere is lowered from Ts to a temperature lower than T1 (for example, room temperature), the rate of temperature decrease may be 1 to 50° C./min. In a case in which the temperature of the atmosphere is raised from a temperature lower than T1 (for example, room temperature) to T1 in order to initiate the first aging treatment, the rate of temperature increase may be 0.1 to 20° C./min. In a case in which the temperature of the atmosphere is lowered from T1 to a temperature lower than T2 (for example, room temperature) after the first aging treatment, the rate of temperature decrease may be 1 to 50° C./min. In a case in which the temperature of the atmosphere is raised from a temperature lower than T2 (for example, room temperature) to T2 in order to initiate the second aging treatment, the rate of temperature increase may be 0.1 to 50° C./min. After the first aging treatment, the temperature of the atmosphere is lowered from T1 to T2, and the second aging treatment may be carried out subsequently to the first aging treatment. In a case in which the temperature of the atmosphere of the aging treatment is lowered from T2 to room temperature after the second aging treatment, the rate of temperature decrease may be 1 to 50° C./min. As the rate of temperature decrease from T2 to room temperature is high, the second T rich phase 3 is easily formed, and the value of S2/(S1+S2) is likely to be from 0.20 to 0.80. When the rate of temperature increase and the rate of temperature decrease in the sintering step, the first aging treatment, and the second aging treatment are in the ranges described above, the above-described Formula 4 and Formula 5 are likely to be satisfied.

By the method described above, the permanent magnet according to the present embodiment is obtained.

In a case in which a permanent magnet containing a heavy rare earth element is produced, a heavy rare earth element or a compound thereof (for example, hydride) is attached to the surface of the sintered body described above, and then the sintered body may be heated. Through this thermal diffusion treatment, the heavy rare earth element can be diffused from the surface to the interior of the sintered body. For example, after the thermal diffusion treatment is carried out subsequently to the sintering step, the first aging treatment and the second aging treatment may be carried out. After the thermal diffusion treatment is carried out subsequently to the first aging treatment, the second aging treatment may be carried out.

The present invention is not intended to be limited to the embodiments described above. For example, the R-T-B based permanent magnet may be a hot-deformed magnet.

EXAMPLES

Hereinafter, the present invention will be described in more detail by way of Examples; however, the present invention is not intended to be limited by these Examples.

Example 3

<Production of Permanent Magnet>

A main phase alloy A and a grain boundary phase alloy A were produced from the raw material metals of a permanent magnet by a strip casting method. The respective compositions of the main phase alloy A and the grain boundary phase alloy A were adjusted by weighing the raw material metals. The concentrations of the various elements in the main phase alloy A were adjusted to the values shown in the following Table 1. The concentrations of the various elements in the grain boundary phase alloy A were adjusted to the values shown in the following Table 1. R in the following Table 1 means Nd and Pr. The respective concentrations of Nd, Pr, Fe, Co, Ga, Al, Cu, and Zr were measured by an X-ray fluorescence analysis. The concentration of B was measured by an ICP emission analysis.

The main phase alloy A and the grain boundary phase alloy A were separately pulverized as follows. The respective steps from the following hydrogen storage pulverization treatment to the sintering step were carried out in a non-oxidative atmosphere in which the oxygen concentration was less than 100 ppm.

Hydrogen was stored in the main phase alloy A, subsequently the main phase alloy A was dehydrogenated by heating for 1 hour at 350° C. in an Ar atmosphere, and thereby a main phase alloy powder was obtained. That is, a hydrogen storage pulverization treatment was carried out as a coarsely pulverizing step. In the following description, the dehydrogenation temperature of the main phase alloy will be described as tm. Oleic acid amide was added as a pulverization aid to the main phase alloy powder, and these were mixed. In a subsequent finely pulverizing step, the average particle size of the main phase alloy powder was adjusted to 4 μm using a jet mill.

Hydrogen was stored in the grain boundary phase alloy A, subsequently the grain boundary phase alloy A was dehydrogenated by heating for 1 hour at 550° C. in an Ar atmosphere, and thereby a grain boundary phase alloy powder was obtained. That is, a hydrogen storage pulverization treatment was carried out as a coarsely pulverizing step. In the following description, the dehydrogenation temperature of the grain boundary phase alloy will be described as tg. Oleic acid amide was added as a pulverization aid to the grain boundary phase alloy powder, and these were mixed. In a subsequent finely pulverizing step, the average particle size of the grain boundary phase alloy powder was adjusted to 4 μm using a jet mill.

The main phase alloy powder and the grain boundary phase alloy powder were weighed such that the overall composition of the mixture of the main phase alloy and the grain boundary phase alloy would be consistent with the composition of the permanent magnet. The composition of the permanent magnet is shown in the following Table 1. These were mixed, and thereby a raw material alloy powder was obtained.

In a molding step, a mold was filled with the raw material alloy powder. Then, while a magnetic field of 1,200 kA/m was applied to the raw material powder in the mold, the raw material powder was pressed at 120 MPa, and thereby a green compact was obtained.

In the sintering step, the green compact was heated in a vacuum at a sintering temperature Ts for 72 hours and then rapidly cooled, and thereby a sintered body was obtained. Ts of Example 3 is shown in the following Table 3.

As the aging treatment step, a first aging treatment and a second aging treatment that was subsequent to the first aging treatment were carried out. In both the first aging treatment and the second aging treatment, the sintered body was heated in an Ar atmosphere.

In the first aging treatment, the sintered body was heated for 60 minutes at 900° C. (first temperature T1).

In the second aging treatment, the sintered body was heated for 60 minutes at a second temperature T2. T2 of Example 3 is presented in the following Table 1.

A permanent magnet of Example 3 was obtained by the above-described method.

<Analysis of Composition of Permanent Magnet>

The overall composition of the permanent magnet was analyzed by an X-ray fluorescence analysis and an ICP emission analysis. The concentrations of the various elements in the permanent magnet were consistent with the values shown in the following Table 1.

<Measurement of Magnetic Characteristics>

The residual magnetic flux density (Br) of the permanent magnet at 23° C. (room temperature) was measured. The unit for Br is mT. The coercivity (HcJ) and squareness ratio (Hk/HcJ) of the permanent magnet at 150° C. (high temperature) were measured. The unit for HcJ is kA/m. For the measurement of Br and HcJ, a B-H tracer was used. Br, HcJ, and Hk/HcJ of Example 3 are presented in the following Table 3.

<Analysis of Cross-Section of Permanent Magnet>

The permanent magnet was cut perpendicularly to the direction of magnetization of the permanent magnet. A cross-section of the permanent magnet was polished by ion milling, and impurities such as oxides formed at the cross-section were removed. Subsequently, a partial region of the cross-section of the permanent magnet was analyzed with a scanning electron microscope (SEM) and an energy dispersive type X-ray spectroscopic (EDS) apparatus. The dimension of the entire region thus analyzed was about 50.8 μm in length×38.1 μm in width. The analyzed region was a region in which the depth from the surface of the permanent magnet was more than 300 μm; in other words, the analyzed region was a region in which the distance from the outer edge (outer periphery) of the cross-section was more than 300 μm, in the cross-section of the permanent magnet. Regarding SEM, a Schottky scanning electron microscope "SU5000" manufactured by Hitachi High-Technologies Corp. was used. Regarding the EDS apparatus, "energy dispersive type X-ray analyzer EMAX Evolution/EMAX ENERGY (specifications: EMAX X-MaxN detector)" manufactured by Horiba, Ltd. was used. The measurement conditions were set as follows.

Accelerating voltage of electron beam: 15 kV

Spot intensity: 30

Working distance: 10 mm

A partial region of the cross-section of the permanent magnet imaged by SEM is shown in FIG. 4. The permanent magnet of Example 3 comprised a large number of main phase grains and grain boundaries surrounded by a plurality of main phase grains. Each main phase grain was a crystalline grain of $(Nd_{1-x}Pr_x)_2(Fe_{1-y}Co_y)_{14}B$. x was 0 or more and less than 1, and y was 0 or more and less than 1. The main phase grains were sites that were darker (black) than any phase of a first T rich phase, a second T rich phase, and a T poor phase that will be described below. Some of the grain boundaries contained the first T rich phase. The first T rich phases were brighter than the main phase grains, but the first T rich phases were the darkest sites (dark gray parts) among the grain boundary phases. Some of the grain boundaries contained the second T rich phase. The second T rich phases were second brightest sites (light gray parts) next to the T poor phases among the grain boundary phases. Some of the grain boundaries contained the T poor phase. The T poor phases were the brightest sites (white parts) among the grain boundary phases. Some of the grain boundary phases contained a ZrC phase. The ZrC phase was sites darker than the main phase grains (black parts). The particle size of the ZrC phase was 0.05 μm or less. There were also sites where both the second T rich phase and the T poor phase existed within one grain boundary multiple junction. Measurement points 1 to 4 in the following Table 2 correspond to the first T rich phase exposed at the cross-section of FIG. 4. Measurement points 5 to 8 in the following Table 2 correspond to the second T rich phase exposed at the cross-section of FIG. 4. Measurement points 9 to 14 in the following Table 2 correspond to the T poor phase exposed at the cross-section of FIG. 4.

The above-described regions analyzed by SEM were analyzed by means of a field emission type transmission electron microscope (FE-TEM) and an energy dispersive type X-ray spectroscopic (TEM-EDS) apparatus. The respective compositions of the measurement points 1 to 14 were specified by TEM-EDS. Regarding FE-TEM, Titan G2 manufactured by FEI Company was used. Regarding the TEM-EDS apparatus, Super-X manufactured by FEI Company was used. The accelerating voltage of the electron beam used for the analysis was 300 kV. The concentrations and [T]/[R] of the various elements at the various measurement points are shown in the following Table 2. [R] in the following Table 2 is the sum of the concentrations of Nd and Pr at each measurement point. [T] in Table 2 is the sum of the concentrations of Fe and Co at each measurement point. [M] in Table 2 is the sum of the concentrations of elements excluding R and T among all the elements described in Table 2.

S1, S2, and S3 were respectively measured in the cross-section of FIG. 4. As described above, the first T rich phase, the second T rich phase, and the T poor phase were identified on the basis of the contrast (difference in the light and shade) in a backscattered electron image captured by SEM. For the respective measurements of S1, S2, and S3, trinarization of the grain boundary phases was carried out manually. The respective S1, S2, and S3 were measured with an image analysis software program. AS the image analysis software program, Mac-View manufactured by Mountech Co., Ltd. was used. S1, S2, S3, (S1+S2)/(S1+S2+S3), and S2/(S1+S2) of Example 3 are presented in the following Table 3. S1, S2, and S3 in Table 3 are relative values with respect to the overall area of the cross-section of FIG. 4. That is, the overall area of the cross-section of FIG. 4 is 100%, and S1, S2, and S3 in Table 3 are proportions of the areas of the first T rich phase, the second T rich phase, and the T poor phase in the cross-section of FIG. 4.

Examples 1, 2, and 4 to 11, and Comparative Examples 1 to 11

As the raw material of the permanent magnet of Example 6, a main phase alloy C and a grain boundary phase alloy C were used instead of the main phase alloy A and the grain boundary phase alloy A. The concentrations of the various elements in the main phase alloy C were adjusted to the values indicated in the following Table 1. The concentrations of the various elements in the grain boundary phase alloy C were adjusted to the values indicated in the following Table 1. The grain boundary phase alloy C contained 15% by mass of Co.

As the raw material of the permanent magnet of Example 7, a main phase alloy D and a grain boundary phase alloy D were used instead of the main phase alloy A and the grain boundary phase alloy A. The concentrations of the various elements in the main phase alloy D were adjusted to the values indicated in the following Table 1. The concentrations of the various elements in the grain boundary phase alloy D were adjusted to the values indicated in the following Table 1. The grain boundary phase alloy D contained 35% by mass of Co.

As the raw material of the permanent magnet of Example 8, a main phase alloy E and a grain boundary phase alloy E were used instead of the main phase alloy A and the grain boundary phase alloy A. The concentrations of the various elements in the main phase alloy E were adjusted to the values indicated in the following Table 1. The concentrations of the various elements in the grain boundary phase alloy E were adjusted to the values indicated in the following Table 1. The grain boundary phase alloy E contained 0.15% by mass of boron (B).

As the raw material of the permanent magnet of Example 9, a main phase alloy F and a grain boundary phase alloy F were used instead of the main phase alloy A and the grain boundary phase alloy A. The concentrations of the various elements in the main phase alloy F were adjusted to the values indicated in the following Table 1. The concentrations of the various elements in the grain boundary phase alloy F were adjusted to the values indicated in the following Table 1. The grain boundary phase alloy F contained 0.25% by mass of boron (B).

As the raw material of the permanent magnet of Comparative Example 1, a main phase alloy B and a grain boundary phase alloy B were used instead of the main phase alloy A and the grain boundary phase alloy A. The concentrations of the various elements in the main phase alloy B were adjusted to the values indicated in the following Table 1. The concentrations of the various elements in the grain boundary phase alloy B were adjusted to the values indicated in the following Table 1. The grain boundary phase alloy B contained 4.0% by mass of Zr.

As the raw material of the permanent magnet of Comparative Example 6, only alloy A' was used instead of the main phase alloy A and the grain boundary phase alloy A. That is, the permanent magnet of Comparative Example 6 was produced according to a one-alloy method. The concentrations of the various elements of the alloy A' were adjusted to the values indicated in the following Table 1.

As the raw material of the permanent magnet of Comparative Example 7, a main phase alloy G and a grain boundary phase alloy G were used instead of the main phase alloy A and the grain boundary phase alloy A. The concentrations of the various elements in the main phase alloy G were adjusted to the values indicated in the following Table 1. The concentrations of the various elements in the grain boundary phase alloy G were adjusted to the values indicated in the following Table 1. The grain boundary phase alloy G contained 5% by mass of Co.

As the raw material of the permanent magnet of Comparative Example 10, a main phase alloy H and a grain boundary phase alloy H were used instead of the main phase alloy A and the grain boundary phase alloy A. The concentrations of the various elements in the main phase alloy H were adjusted to the values indicated in the following Table 1. The concentrations of the various elements in the grain boundary phase alloy H were adjusted to the values indicated in the following Table 1. The grain boundary phase alloy H contained 50% by mass of Co.

As the raw material of the permanent magnet of Comparative Example 8, a main phase alloy I and a grain boundary phase alloy I were used instead of the main phase alloy A and the grain boundary phase alloy A. The concentrations of the various elements in the main phase alloy I were adjusted to the values indicated in the following Table 1. The concentrations of the various elements in the grain boundary phase alloy I were adjusted to the values indicated in the following Table 1.

As the raw material of the permanent magnet of Example 11, a main phase alloy J and a grain boundary phase alloy J were used instead of the main phase alloy A and the grain boundary phase alloy A. The concentrations of the various elements in the main phase alloy J were adjusted to the values indicated in the following Table 1. The concentrations of the various elements in the grain boundary phase alloy J were adjusted to the values indicated in the following Table 1. The grain boundary phase alloy J contained 0.50% by mass of boron (B).

The dehydrogenation temperatures tm of the respective main phase alloys of Examples 1, 2, and 4 to 11 and Comparative Examples 1 to 11 were the temperatures indicated in the following Table 3. However, in Comparative Example 6, since one kind of alloy (alloy A') only was used, tm of Comparative Example 6 means the dehydrogenation temperature of the alloy A'. The dehydrogenation temperatures tg of the respective grain boundary phase alloys of Examples 1, 2, and 4 to 11 and Comparative Examples 1 to 5 and 7 to 11 was the temperatures indicated in the following Table 3. The respective sintering temperatures Ts of Examples 1, 2, and 4 to 11 and Comparative Examples 1 to 11 were the temperatures indicated in the following Table 3. The respective second temperatures T2 of Examples 1, 2, and 4 to 11 and Comparative Examples 1 to 11 were the temperatures indicated in the following Table 3.

The respective permanent magnets of Examples 1, 2, and 4 to 11 and Comparative Examples 1 to 11 were produced by a method similar to Example 3, except for the above-described matters.

By a method similar to Example 3, the overall compositions of the respective permanent magnets of Examples 1, 2, and 4 to 11 and Comparative Examples 1 to 11 were analyzed. In all cases of Examples 1, 2, and 4 to 11 and Comparative Examples 1 to 11, the concentrations of the various elements in the permanent magnets were consistent with the values indicated in the following Table 1.

By a method similar to Example 3, Br, HcJ, and Hk/HcJ of the respective permanent magnets of Examples 1, 2, and 4 to 11 and Comparative Examples 1 to 11 were measured. The respective values of Br, HcJ, and Hk/HcJ of Examples 1, 2, and 4 to 11 and Comparative Examples 1 to 11 are presented in the following Table 3.

By a method similar to Example 3, cross-sections of the respective permanent magnets of Examples 1, 2, and 4 to 11 and Comparative Examples 1 to 11 were analyzed.

The respective permanent magnets of Examples 1, 2, and 4 to 11 and Comparative Examples 1 to 11 comprised a large number of main phase grains and grain boundaries surrounded by a plurality of the main phase grains. The respective permanent magnets of Examples 1, 2, and 4 to 11 and Comparative Examples 2 to 11 contained a first T rich phase, a second T rich phase, and a T poor phase as the grain boundary phases. The permanent magnet of Comparative Example 1 contained a first T rich phase and a T poor phase as the grain boundary phases. However, the permanent magnet of Comparative Example 1 did not contain a second T rich phase. The results of the analyses of all Examples and Comparative Examples showed that [T]/[R] of the first T rich phase was from 1.7 to 3.0. The results of the analyses of all Examples and Comparative Examples showed that [T]/[R] of the second T rich phase was from 0.8 to 1.5. The results of the analyses of all Examples and Comparative Examples showed that [T]/[R] of the T poor phase was from 0.0 to 0.6.

The respective values of S1, S2, S3, (S1+S2)/(S1+S2+S3), and S2/(S1+S2) of Examples 1, 2, and 4 to 11 and Comparative Examples 1 to 11 are shown in the following Table 3.

TABLE 1

| | | Concentrations of various elements (mass %) | | | | | | | | | |
|---|---|---|---|---|---|---|---|---|---|---|---|
| | | R | Nd | Pr | B | Co | Ga | Cu | Al | Zr | Fe |
| Examples 1 to 5 | Main phase alloy A | 31.5 | 25.2 | 6.3 | 0.94 | 0.0 | 0.5 | 0.1 | 0.2 | 0.2 | bal. |
| Comparative Examples 2 to 5 and 9 to 11 | Grain boundary phase alloy A | 40.0 | 32.0 | 8.0 | 0.20 | 20.0 | 0.0 | 0.0 | 0.1 | 0.0 | bal. |
| Comparative Example 1 | Main phase alloy B | 31.5 | 25.2 | 6.3 | 0.94 | 0.0 | 0.5 | 0.1 | 0.2 | 0.0 | bal. |
| | Grain boundary phase alloy B | 40.0 | 32.0 | 8.0 | 0.20 | 20.0 | 0.0 | 0.0 | 0.1 | 4.0 | bal. |
| Comparative Example 6 | Alloy A' | 31.9 | 25.5 | 6.4 | 0.90 | 1.0 | 0.5 | 0.1 | 0.2 | 0.2 | bal. |
| Example 6 | Main phase alloy C | 31.5 | 25.2 | 6.3 | 0.94 | 0.3 | 0.5 | 0.1 | 0.2 | 0.2 | bal. |
| | Grain boundary phase alloy C | 40.0 | 32.0 | 8.0 | 0.20 | 15.0 | 0.0 | 0.0 | 0.1 | 0.0 | bal. |
| Example 7 | Main phase alloy D | 31.7 | 25.4 | 6.4 | 0.91 | 0.3 | 0.5 | 0.1 | 0.2 | 0.2 | bal. |
| | Grain boundary phase alloy D | 40.0 | 32.0 | 8.0 | 0.20 | 35.0 | 0.0 | 0.0 | 0.1 | 0.0 | bal. |
| Example 8 | Main phase alloy E | 31.5 | 25.2 | 6.3 | 0.94 | 0.0 | 0.5 | 0.1 | 0.2 | 0.2 | bal. |
| | Grain boundary phase alloy E | 40.0 | 32.0 | 8.0 | 0.15 | 20.0 | 0.0 | 0.0 | 0.1 | 0.0 | bal. |
| Example 9 | Main phase alloy F | 31.5 | 25.2 | 6.3 | 0.93 | 0.0 | 0.5 | 0.1 | 0.2 | 0.2 | bal. |
| | Grain boundary phase alloy F | 40.0 | 32.0 | 8.0 | 0.25 | 20.0 | 0.0 | 0.0 | 0.1 | 0.0 | bal. |
| Comparative Example 7 | Main phase alloy G | 31.5 | 25.2 | 6.3 | 0.94 | 0.8 | 0.5 | 0.1 | 0.2 | 0.2 | bal. |
| | Grain boundary phase alloy G | 40.0 | 32.0 | 8.0 | 0.20 | 5.0 | 0.0 | 0.0 | 0.1 | 0.0 | bal. |
| Example 10 | Main phase alloy H | 31.7 | 25.4 | 6.4 | 0.91 | 0.0 | 0.5 | 0.1 | 0.2 | 0.2 | bal. |
| | Grain boundary phase alloy H | 40.0 | 32.0 | 8.0 | 0.20 | 50.0 | 0.0 | 0.0 | 0.1 | 0.0 | bal. |
| Comparative Example 8 | Main phase alloy I | 31.5 | 25.2 | 6.3 | 0.95 | 0.0 | 0.5 | 0.1 | 0.2 | 0.2 | bal. |
| | Grain boundary phase alloy I | 40.0 | 32.0 | 8.0 | 0.00 | 20.0 | 0.0 | 0.0 | 0.1 | 0.0 | bal. |
| Example 11 | Main phase alloy J | 31.5 | 25.2 | 6.3 | 0.92 | 0.0 | 0.5 | 0.1 | 0.2 | 0.2 | bal. |
| | Grain boundary phase alloy J | 40.0 | 32.0 | 8.0 | 0.50 | 20.0 | 0.0 | 0.0 | 0.1 | 0.0 | bal. |
| All Examples and all Comparative Examples | Permanent magnet | 31.9 | 25.5 | 6.4 | 0.90 | 1.0 | 0.5 | 0.1 | 0.2 | 0.2 | bal. |

TABLE 2

| | Measurement point | Concentrations of various elements (atom %) Al | Si | Fe | Co | Cu | Ga | Pr | Nd | [R] | [T] | [M] | [T]/[R] |
|---|---|---|---|---|---|---|---|---|---|---|---|---|---|
| First T rich phase | 1 | 0.9 | 0.0 | 66.2 | 2.1 | 0.9 | 1.3 | 7.3 | 21.3 | 28.6 | 68.3 | 3.1 | 2.4 |
| | 2 | 0.4 | 0.1 | 59.0 | 3.4 | 1.0 | 5.3 | 8.0 | 22.8 | 30.8 | 62.4 | 6.8 | 2.0 |
| | 3 | 0.5 | 0.1 | 56.0 | 3.6 | 0.8 | 5.5 | 8.5 | 25.0 | 33.5 | 59.6 | 6.9 | 1.8 |
| | 4 | 0.4 | 0.1 | 54.5 | 3.6 | 1.4 | 5.6 | 8.8 | 25.6 | 34.4 | 58.1 | 7.5 | 1.7 |
| Second T rich phase | 5 | 0.6 | 0.2 | 36.8 | 5.5 | 5.5 | 4.5 | 12.2 | 34.7 | 46.9 | 42.3 | 10.8 | 0.9 |
| | 6 | 1.4 | 0.0 | 44.2 | 4.2 | 5.6 | 4.7 | 10.1 | 29.8 | 39.9 | 48.4 | 11.7 | 1.2 |
| | 7 | 1.1 | 0.0 | 46.9 | 3.8 | 4.6 | 5.0 | 9.3 | 29.3 | 38.6 | 50.7 | 10.7 | 1.3 |
| | 8 | 0.6 | 0.1 | 48.4 | 3.7 | 4.6 | 5.1 | 9.2 | 28.3 | 37.5 | 52.1 | 10.4 | 1.4 |
| T poor phase | 9 | 0.8 | 0.0 | 2.8 | 14.8 | 9.1 | 0.4 | 20.7 | 51.4 | 72.1 | 17.6 | 10.3 | 0.2 |
| | 10 | 0.1 | 0.2 | 5.8 | 9.8 | 9.0 | 12.6 | 17.0 | 45.5 | 62.5 | 15.6 | 21.9 | 0.2 |
| | 11 | 0.4 | 0.0 | 13.7 | 2.4 | 9.6 | 6.2 | 17.2 | 50.5 | 67.7 | 16.1 | 16.2 | 0.2 |
| | 12 | 0.3 | 0.1 | 3.0 | 13.1 | 8.0 | 0.2 | 21.4 | 53.9 | 75.3 | 16.1 | 8.6 | 0.2 |
| | 13 | 0.6 | 0.2 | 17.6 | 1.6 | 29.0 | 4.0 | 11.3 | 35.7 | 47.0 | 19.2 | 33.8 | 0.4 |
| | 14 | 0.0 | 0.2 | 5.6 | 9.8 | 9.0 | 12.8 | 16.8 | 45.8 | 62.6 | 15.4 | 22.0 | 0.2 |

TABLE 3

| | S1 (%) | S2 (%) | S3 (%) | (S1 + S2)/(S1 + S2 + S3) | S2/(S1 + S2) | tm (° C.) | tg (° C.) | Ts (° C.) | T2 (° C.) | Br (mT) | HcJ (kA/m) | Hk/HcJ (%) |
|---|---|---|---|---|---|---|---|---|---|---|---|---|
| Example 1 | 1.758 | 1.172 | 5.441 | 0.35 | 0.40 | 350 | 550 | 980 | 460 | 1390 | 595 | 98.1 |
| Example 2 | 3.000 | 1.000 | 4.510 | 0.47 | 0.25 | 350 | 550 | 980 | 500 | 1384 | 619 | 97.8 |
| Example 3 | 2.146 | 2.460 | 3.794 | 0.55 | 0.53 | 350 | 550 | 980 | 520 | 1381 | 628 | 98.0 |
| Example 4 | 0.966 | 3.234 | 4.200 | 0.50 | 0.77 | 350 | 550 | 960 | 510 | 1379 | 580 | 97.5 |
| Example 5 | 2.918 | 3.566 | 1.937 | 0.77 | 0.55 | 350 | 550 | 980 | 540 | 1376 | 590 | 97.3 |
| Example 6 | 3.300 | 1.300 | 3.500 | 0.57 | 0.28 | 350 | 550 | 980 | 520 | 1376 | 588 | 98.0 |
| Example 7 | 2.600 | 2.400 | 3.200 | 0.61 | 0.48 | 350 | 550 | 980 | 520 | 1373 | 616 | 95.5 |
| Example 8 | 3.400 | 1.200 | 3.400 | 0.58 | 0.26 | 350 | 550 | 980 | 520 | 1377 | 585 | 97.7 |
| Example 9 | 2.800 | 2.600 | 4.000 | 0.57 | 0.48 | 350 | 550 | 980 | 520 | 1378 | 612 | 95.9 |
| Comparative Example 1 | 4.316 | 0.000 | 3.984 | 0.52 | 0.00 | 350 | 550 | 980 | 500 | 1386 | 545 | 98.0 |
| Comparative Example 2 | 3.974 | 0.701 | 3.825 | 0.55 | 0.15 | 350 | 550 | 1000 | 500 | 1386 | 547 | 97.4 |
| Comparative Example 3 | 0.635 | 3.336 | 4.479 | 0.47 | 0.84 | 350 | 550 | 950 | 500 | 1362 | 533 | 97.8 |
| Comparative Example 4 | 1.232 | 0.528 | 6.240 | 0.22 | 0.30 | 350 | 550 | 980 | 440 | 1409 | 450 | 97.6 |
| Comparative Example 5 | 5.326 | 2.506 | 0.968 | 0.89 | 0.32 | 350 | 550 | 980 | 580 | 1355 | 540 | 98.1 |
| Comparative Example 6 | 3.300 | 0.040 | 3.400 | 0.50 | 0.01 | 550 | — | 980 | 520 | 1379 | 552 | 97.7 |
| Comparative Example 7 | 4.220 | 0.460 | 3.794 | 0.55 | 0.10 | 350 | 550 | 980 | 520 | 1380 | 543 | 98.7 |
| Example 10 | 3.110 | 1.550 | 3.550 | 0.57 | 0.33 | 350 | 550 | 980 | 520 | 1376 | 590 | 87.6 |
| Comparative Example 8 | 3.660 | 0.150 | 3.770 | 0.50 | 0.04 | 350 | 550 | 980 | 520 | 1378 | 533 | 97.4 |
| Example 11 | 2.560 | 2.000 | 3.480 | 0.57 | 0.44 | 350 | 550 | 980 | 520 | 1372 | 581 | 89.9 |
| Comparative Example 9 | 3.500 | 0.050 | 3.000 | 0.54 | 0.01 | 350 | 350 | 980 | 520 | 1380 | 534 | 97.3 |
| Comparative Example 10 | 3.500 | 0.600 | 3.000 | 0.58 | 0.15 | 450 | 450 | 980 | 520 | 1380 | 547 | 97.9 |
| Comparative Example 11 | 3.500 | 0.030 | 3.000 | 0.54 | 0.01 | 550 | 550 | 980 | 520 | 1380 | 535 | 97.9 |

INDUSTRIAL APPLICABILITY

The R-T-B based permanent magnet according to the present invention has excellent magnetic characteristics, and therefore, the permanent magnet is applied to, for example, motors that are mounted in hybrid cars or electric cars.

REFERENCE SIGNS LIST

2: R-T-B based permanent magnet, 2*cs*: cross-section of R-T-B based permanent magnet, 1: first T rich phase, 3: second T rich phase, 4: main phase grain, 5: T poor phase, 6: grain boundary multiple junction, 10: two-grain boundary.

What is claimed:

1. An R-T-B based permanent magnet including a rare earth element R, a transition metal element T, B, and Ga, wherein the R-T-B based permanent magnet includes at least Nd as R, the R-T-B based permanent magnet includes at least Fe as T, the R-T-B based permanent magnet comprises a plurality of main phase grains containing Nd, T, and B; and grain boundaries surrounded by a plurality of the main phase grains, at least a portion of the grain boundaries contains a first T rich phase, at least a portion of the grain boundaries contains a second T rich phase, at least a portion of the grain boundaries contains a T poor phase, the first T rich phase is a phase containing Nd, Ga, and at least one of Fe and Co and satisfying the following Formula 1, the second T rich phase is a phase containing Nd, Ga, and at least one of Fe and Co and satisfying the following Formula 2, the T poor phase is a phase containing Nd and satisfying the following Formula 3, the first T rich phase, the second T rich phase, and the T poor phase satisfy the following Formula 4, and the first T rich phase and the second T rich phase satisfy the following Formula 5:

$$1.7 \leq [T]/[R] \leq 3.0 \quad (1)$$

$$0.8 \leq [T]/[R] \leq 1.5 \quad (2)$$

$$0.0 \leq [T]/[R] \leq 0.6 \quad (3)$$

wherein [T] in the Formula 1 represents the sum of the concentrations of Fe and Co in the first T rich phase; [R] in the Formula 1 represents the sum of the concentrations of Nd, Pr, Tb, and Dy in the first T rich phase; [T] in the Formula 2 represents the sum of the concentrations of Fe and Co in the second T rich phase; [R] in the Formula 2 represents the sum of the concentrations of Nd, Pr, Tb, and Dy in the second T rich phase; [T] in the Formula 3 represents the sum of the concentrations of Fe and Co in the T poor phase; [R] in the Formula 3 represents the sum of the concentrations of Nd, Pr, Tb, and Dy in the T poor phase; and the respective units of [T] and [R] in the Formula 1, the Formula 2, and the Formula 3 are atom %, $$0.30 \leq (S1+S2)/(S1+S2+S3) \leq 0.80 \quad (4)$$

$$0.20 \leq S2/(S1+S2) \leq 0.80 \quad (5)$$

wherein S1 in the Formula 4 and the Formula 5 represents the sum of the areas of the first T rich phase exposed at a cross-section of the R-T-B based permanent magnet; S2 in the Formula 4 and the Formula 5 represents the sum of the areas of the second T rich phase exposed at the cross-section of the R-T-B based permanent magnet; and S3 in the Formula 4 represents the sum of the areas of the T poor phase exposed at the cross-section of the R-T-B based permanent magnet.

2. The R-T-B based permanent magnet according to claim 1, wherein the R-T-B based permanent magnet comprises grain boundary multiple junctions surrounded by three or more of the main phase grains, as the grain boundaries, and both of the second T rich phase and the T poor phase exist within one grain boundary multiple junction.

3. The R-T-B based permanent magnet according to claim 1, wherein the R-T-B based permanent magnet is composed of 29.50% to 33.00% by mass of R;

0.70% to 0.95% by mass of B;

0.03% to 0.60% by mass of Al;

0.01% to 1.50% by mass of Cu;

0.00% to 3.00% by mass of Co;

0.10% to 1.00% by mass of Ga;

0.05% to 0.30% by mass of C;

0.03% to 0.40% by mass of O; and the balance, and the balance is Fe only, or Fe and other elements.

4. The R-T-B based permanent magnet according to claim 1, wherein the sum of the contents of heavy rare earth elements is from 0.00% by mass to 1.00% by mass.

5. The R-T-B based permanent magnet according to claim 1, wherein the T poor phase contains at least one of Cu and Ga.

* * * * *